US005662202A

United States Patent [19]

Suris

[11] Patent Number: 5,662,202

[45] Date of Patent: Sep. 2, 1997

[54] CURRENCY VALIDATOR WITH CASSETTE CASH BOX

[75] Inventor: Vladimir Suris, Mayfield Heights, Ohio

[73] Assignee: Ardac Incorporated, Eastlake, Ohio

[21] Appl. No.: 562,398

[22] Filed: Nov. 24, 1995

[51] Int. Cl.[6] ..... G07F 7/04

[52] U.S. Cl. ..... 194/206; 194/207; 271/181

[58] Field of Search ..... 194/206, 207; 271/3.17, 176, 180, 181

[56] References Cited

U.S. PATENT DOCUMENTS

| | | | |
|---|---|---|---|
| 4,011,931 | 3/1977 | Wyckoff | 194/206 |
| 4,556,139 | 12/1985 | Akagawa | 194/207 |
| 4,678,072 | 7/1987 | Kobayashi et al. | 271/181 X |
| 4,834,230 | 5/1989 | Kondo et al. | 194/206 |
| 5,251,738 | 10/1993 | Dabrowski | 194/206 |
| 5,372,361 | 12/1994 | Isobe et al. | 271/181 |
| 5,421,443 | 6/1995 | Hatamachi et al. | 194/206 |

*Primary Examiner*—Karen B. Merritt
*Assistant Examiner*—Scott L. Lowe
*Attorney, Agent, or Firm*—Renner, Kenner, Greive, Bobak, Taylor & Weber

[57] ABSTRACT

A currency validator with a cash cassette for use in vending machines has an acceptor module for receiving various sizes and denominations of currency, a sensor which confirms the validity of the currency and a drive unit which transfers the currency to a stacker mechanism for inserting the currency into a cassette cash box that is securable and tamper resistant. The currency validator also has a screw drive mechanism operative with the stacker wherein the screw drive mechanism controls the movement of the stacker to insert the currency into the cassette cash box. A processor controls the stroke or movement of the stacker mechanism depending upon the size of the currency inserted into the currency validator. Moreover, the cassette cash box is structured such that the stacker is included within the cassette cash box and is operatively controlled by the rotation and movement of the screw drive mechanism which may also be included in the cash cassette. The cassette cash box is detachably mounted within the currency validator housing and is easily exchanged with an empty cassette cash box so as to reduce the downtime of the vending machine which is connected to the currency validator.

18 Claims, 3 Drawing Sheets

CURRENCY VALIDATOR WITH CASSETTE CASH BOX

TECHNICAL FIELD

The invention herein resides generally in the art of currency validators for currency activated machines. More particularly, the present invention relates to a currency validator with a detachable cash box cassette that receives and holds paper currency in a safe and secure manner. Specifically, the present invention relates to a paper currency validator which receives and recognizes different sizes of notes and adjusts the movement or stroke of a screw drive mechanism to move the note from a receiving position to a retained position within the cassette cash box.

BACKGROUND ART

It is well known to provide coin and currency validation modules in currency activated machines such as snack vending machines, money changers, ticket purchase machines, gaming devices and the like. Once the inserted currency is validated, these machines transfer the currency to a storage compartment or cash box that is subsequently accessed by service personnel for retrieval of the currency. In many machines, the cash box is permanent and the currency is simply taken from it. In others, the cash box is in the form of a cassette such that service simply entails removing the cassette with its currency contents and replacing it with an empty one. These detachable cash boxes are easily interchanged such that an empty cash box replaces a full cash box to minimize machine downtime.

Currency validators with cash boxes have been developed to incorporate various desirable features. These features include a validation mechanism whereby if various criteria are tested and are not met, the mechanism returns the invalid currency to the user of the device. The detachable cassette cash box or storage compartments are constructed to be secure and tamper resistant from unauthorized personnel. Exemplary security features include locking devices in which two separate keys are required to open the storage compartment and a variety of latches and connections which are difficult to open by untrained personnel. These devices are also constructed to require minimum maintenance, while being rugged in design to withstand extensive use.

U.S. Pat. No. 5,372,361 presents a bill handling apparatus with an exchangeable pusher for a stacker. In particular, this patent discloses a casing of a stacker provided with an opening and a chamber. A pusher, for pushing the currency into the chamber, is received within the casing and adjacent to the opening so that the pusher can be removably attached within the stacker. This allows the storage capacity of the compartment to be easily changed by inserting the desired stacker as required for the particular application of the bill handling apparatus. Additionally, the removable feature of the pusher from the stacker allows for an exchange of pushers if there are any malfunctions therewith.

Another type of currency validator is disclosed in U.S. Pat. No. 5,405,131. This patent discloses a currency validation and storage arrangement which includes a currency validation and transport unit and a currency storage cassette which are slidably removable from a chassis. A cam driver actuating fork and interrupt arm are employed to push currency from a pre-stacking to a stacked position and to sense both a stacking operation and the removal or presence of the removable currency cassette. Moreover, this patent teaches the elimination of any electrical or electronic components in the removable currency cassette for purposes of sensing its presence or absence.

Although the above patents are effective in achieving their stated purposes, neither device is adaptable to receive various sizes and denominations of paper currency within the same cash receiving cassette. Nor do either of the devices provide a quick and reliably repeatable mechanism for performing such an operation. These and other devices do not provide a currency validator which adjusts the amount of movement or length of stroke of the mechanism used to stack the currency. Moreover, these devices do not provide a stacking mechanism with the above features that can be easily interchanged and which is secure and tamper resistant.

Based upon the foregoing, it is evident that there is a need for a currency validator with cassette cash box that can accept various sizes and denominations of paper currency. Furthermore, there is also a need for a currency validator with a stacking mechanism that is adjustable so as to accomodate the various sizes and denominations of paper currency.

DISCLOSURE OF INVENTION

In light of the foregoing, it is a first aspect of the present invention to provide a currency validator with a cassette cash box.

Another aspect of the present invention is to provide a currency validator with a cassette cash box as described above, wherein the cassette cash box is easily securable and provides a rugged construction which precludes unauthorized entry.

Still a further aspect of the present invention is to provide a currency validator with a cassette cash box as described above, wherein the cassette cash box is easily exchangeable from the currency validator to reduce the downtime of the machine in which it is installed.

An additional aspect of the present invention is to provide a currency validator with a cassette cash box as described above, wherein different sizes and denominations of currency are received and stored by the structure thereof.

Yet an additional aspect of the present invention is to provide a currency validator with a cassette cash box as described above, wherein a screw drive mechanism is employed in conjunction with a stacking device and the movement or stroke of the screw drive is controlled as a function of the currency size inserted therein.

A further aspect of the present invention is to provide a currency validator with a cassette cash box as described above, where the screw drive mechanism and stacker are incorporated within the cash cassette.

Yet a further aspect of the present invention is to provide a currency validator with a cassette cash box as described above, wherein the stacking mechanism is incorporated within the cassette cash box.

The foregoing and other aspects of the present invention which shall become apparent as the detailed description proceeds, are achieved by a currency validator with a cassette cash box, comprising: an acceptor module for receiving various sizes of currency; a device for validating whether the currency meets predetermined criteria; a stacker for receiving the currency from the acceptor module and inserting the currency into a cassette cash box; and a screw drive mechanism operative with the stacker, wherein the screw drive mechanism controls the movement of the stacker to insert the currency into the cassette cash box.

The present invention also provides a currency validator with a detachable cassette cash box for receiving and storing currency, comprising: means for accepting currency; means for transferring inserted currency to a preliminary position; a screw drive mechanism; and means for punching the currency from the preliminary position to a held position within a detachable cash cassette by engaging the screw drive mechanism to move the punching means a predetermined distance and then returning the punching means the predetermined distance.

The present invention also provides a currency validator, comprising: a housing; a cassette cash box detachably received within the housing, the cassette cash box receiving and holding various sizes of currency; and a stacker contained within the cassette cash box, the stacker operatively controlled by a screw drive mechanism, wherein the screw drive mechanism selectively engages the stacker to move the currency from a received position to a held position within the cassette cash box.

BEST MODE FOR CARRYING OUT THE INVENTION

Figure 1:
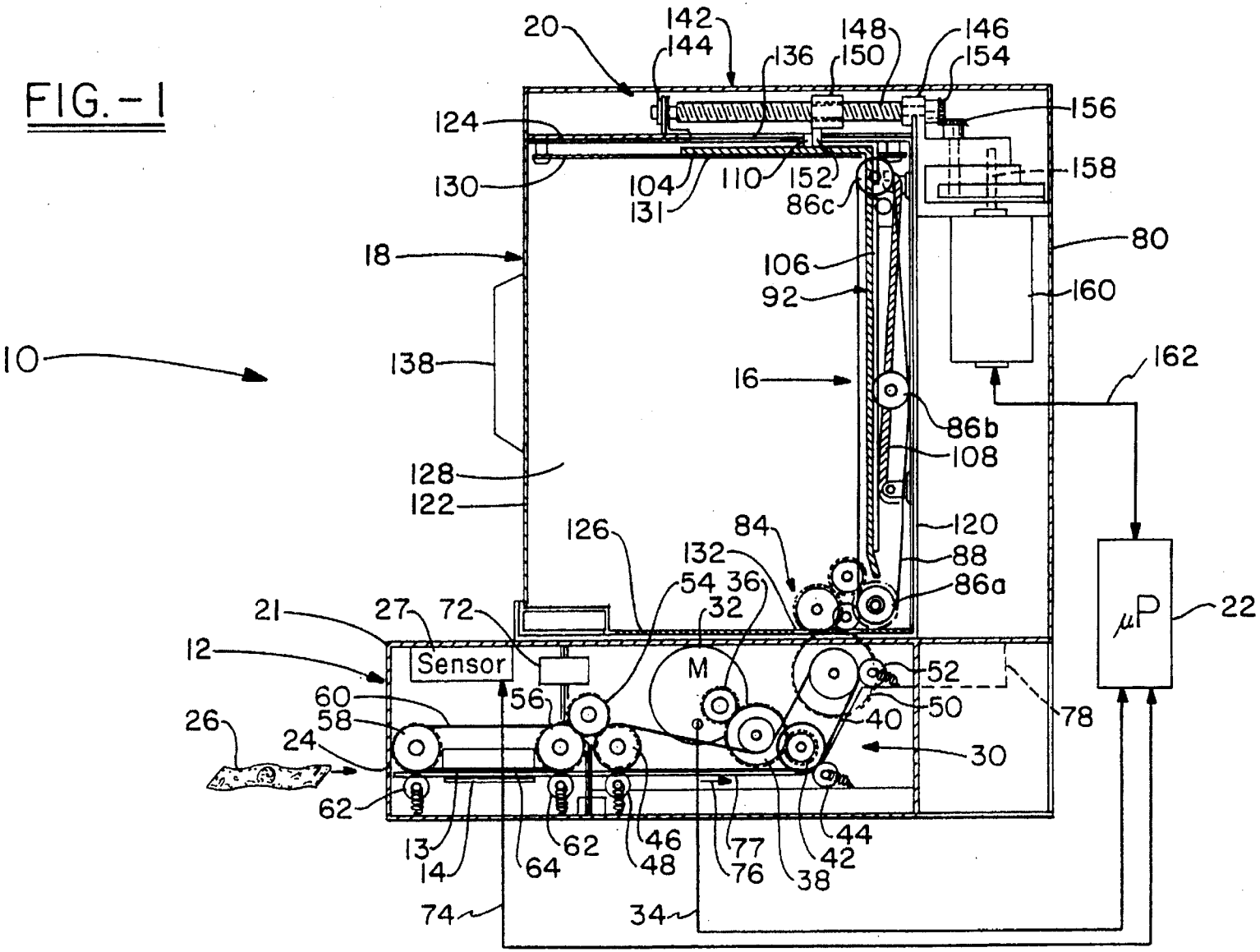
FIG. 1 is a partial cross-sectional view and a partial schematic view of a currency validator with a cassette cash box according to the present invention.

Referring now to the drawings and more particularly to FIG. 1, it can be seen that a currency validator with a cassette cash box according to the present invention is designated generally by the numeral 10. Generally, the currency validator 10 includes an acceptor module 12, a stacker device 16 contained within a cassette cash box 18, which is detachable from each of the acceptor 12 or the stacker 16, and a screw drive mechanism 20. As will be described in detail hereinbelow, the acceptor module 12 accepts various sizes of currency which are validated by a top sensor plate 13 and a bottom sensor plate 14 to determine whether the currency is acceptable according to various predetermined criteria. The acceptor module 12 transfers the currency, if acceptable, to the stacker 16 which inserts the currency into a cassette cash box 18. The movement of the stacker 16 is controlled by the screw drive mechanism 20. The preferred embodiment shown in FIG. 1 is an "up-stacker" configuration. In other words, the currency is moved upwardly from the acceptor module 12 to the stacker device 16. Of course, the currency validator 10 could be configured in a "down-stacker" configuration, as well.

In particular, the currency validator 10 has a housing 21 which includes the acceptor module 12, the top sensor plate 13, the bottom sensor plate 14 and any other structure required to fit the currency validator 10 within a vending machine (not shown). The operation of the currency validator 10 is controlled by a processor 22 which receives and generates various electrical signals to control the operation of the various motors, sensors and mechanical devices of the validator 10 in a synchronized and efficient manner. To start the operation of the currency validator 10 a consumer inserts into the acceptor module 12, which has an appropriate opening 24, a cash note or currency 26 that is offered as legal tender. It will be appreciated that the acceptor module 12 can accomodate various denominations and sizes of currency 26. The top sensor plate 13 carries a sensor 27 for determining the validity of any paper tendered as currency and inserted into the acceptor module 12. Of course, the sensor 27 could be carried by the bottom sensor plate 14, or multiple sensors could be carried by both the top and bottom sensor plates 13, 14.

A drive unit 30 is connected to the acceptor 12 for the purpose of transferring the currency into the stacker assembly 16. In particular, the drive unit 30 includes a motor 32 which is operatively controlled by a signal line 34 connected to the processor 22. The motor 32 drives a gear 36 which meshingly engages a belt gear 38. The belt gear 38 engages and moves a transfer belt 40 which functions to transfer currency 26 from the acceptor module 12 to the stacker assembly 16. To assist the rotation and direction of the transfer belt 40, the belt gear 38 meshes with a belt gear and associated belt pulley 42 that is biased by a spring roller 44. Those skilled in the art will appreciate that the transfer belt 40 is received between the belt gear/pulley 42 and the spring roller 44 in such a manner to provide the proper pinch of transfer belt 40. In a similar manner, the transfer belt 40 meshes with a belt gear and associated belt pulley 46 biased by a spring roller 48 and a belt gear and associated belt pulley 50 which is biased by a spring roller 52. Meshingly engaged with the belt gear 46 is a transfer gear 54 which functions to rotate an acceptor gear and associated belt pulley 56. In particular, the transfer gear 54 rotates the acceptor gear/pulley 56 so as to rotate an acceptor belt 60 which in turn rotates an acceptor gear and associated pulley 58. Both acceptor pulleys 56 and 58 are biased by corresponding spring rollers 62. A guide plate 64 is positioned in the acceptor module 12 so that the inserted currency 26 is disposed between the acceptor belt 60 and the guide plate 64.

A connector 72 interconnects the drive unit 30 to the acceptor module 12. A signal line 74 transfers the appropriate signals from the sensor device 27 to the processor 22. Therefore, those skilled in the art will appreciate that a currency path 76 is established between the acceptor belt 60 and the guide plate 64 and continues between the transfer belt 40 and a guide plate 77. A connector 78 interconnects the drive unit 30 to a motor housing 80.

The stacker assembly 16, which is contained within the cassette cash box 18, includes a stacker gear assembly 84 that is operatively connected to and driven by the belt gear 50 contained within the drive unit 30. The stacker gear assembly 84 includes a plurality of stacker rollers **86*a*, 86*b* and 86*c* which meshingly engage and drive a stacker belt 88** in a manner well known in the art.

Figure 2:
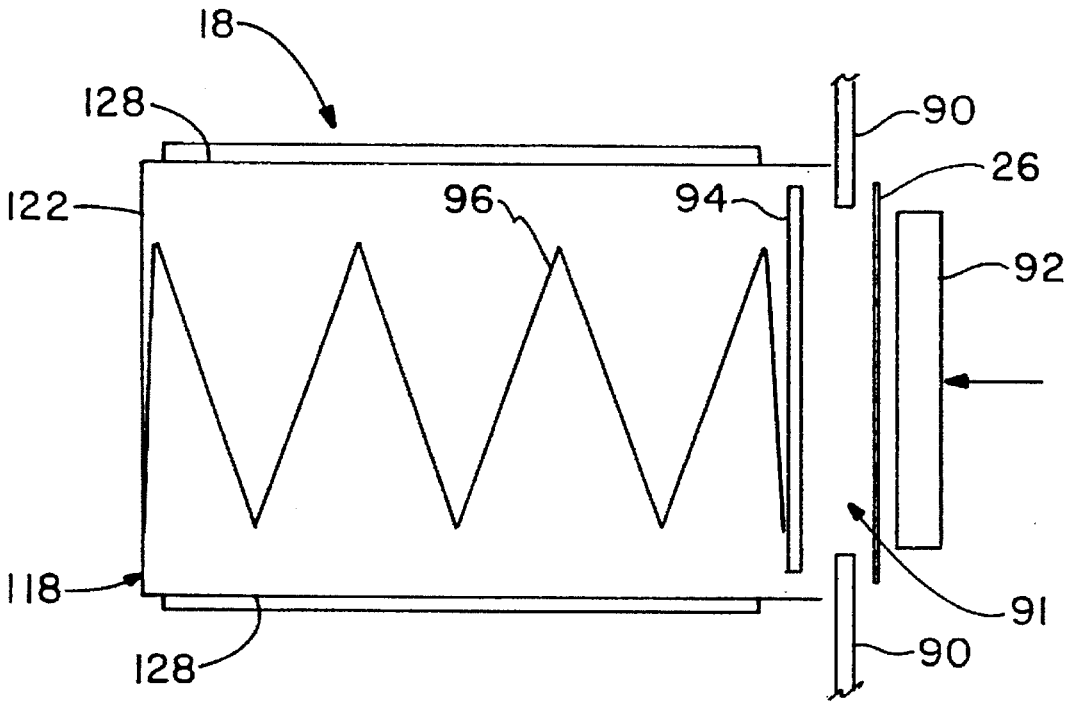
FIG. 2 is a schematic top view of a cassette cash box housing according to the present invention.
Figure 3:
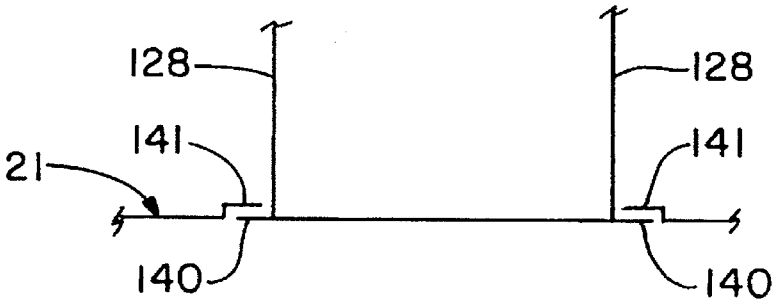
FIG. 3 is a partial cross-sectional view of a slide rail employed by the cassette cash box according to the present invention.

Referring now to FIGS. 1, 2 and 3 it can be seen that included within the cassette cash box 18 are a pair of opposed side rails 90 which form an opening 91. The stacker assembly 16 also includes a punch plate 92 which is sized to fit between the side rails 90 into the opening 91. Those skilled in the art will appreciate that the currency 26 is transferred by the stacker belt 88 into a receiving or preliminary position between the side rails 90 and the punch plate 92. Contained within the cassette cash box 18 is a holding plate 94 biased by a holding spring 96. The holding spring is attached at one end to the holding plate 94 and at its opposite end to the inside of the cassette cash box 18. Extending from the punch plate 92 is an actuating member 104. A plate 106 provides a means for interconnecting the punch plate 92 to a pull-back spring 108 which is connected to the interior of the cassette cash box 18. Extending from the actuating member 104 is an engaging flange 110.

The cassette cash box 18 includes a housing 118 that is formed by a back wall 120, a front wall 122, a top 124, a bottom 126 and interconnecting sidewalls 128. Those skilled in the art will appreciate then that the cassette housing 118 defines a receptacle that is tamper resistant and provides a secure means for transferring currency stored therein to a centralized location. A guide wall 130, which is substantially parallel with top 124, is contained within the cassette housing 118 to provide support for the operation of the actuating member 104 which will be described later. The bottom 126 has a gear opening 132 which allows the stacker gear assembly 84 to mesh with and engage the belt gear 50. The motor 32 controls the rotation and operation of the stacker gear assembly 84 and provides a means for driving the stacker belt 88. The top 124 has a flange opening 136 which allows the free and unencumbered movement of the engaging flange 110. A handle 138 is shown secured to the front wall 122 to allow the easy removal and insertion of the cassette cash box 18 as desired. It will be appreciated that the handle 138 could be connected anywhere on the cassette cash box 18 to allow the insertion and extraction thereof.

Extending from the sidewalls 128 are slide rails 140 which are received by the housing 21. In particular, the housing 21 has tracks 141 for slidably receiving the slide rails 140. Of course, the housing 21 and the cassette housing 118 can be configured with other slidable or detachable features to facilitate the easy insertion and extraction of the cassette cash box 18 with respect to the housing 21.

A screw drive housing 142, which contains the screw drive mechanism 20, is connected to the motor housing 80 and positioned in such a manner so as to be operative with the cassette housing 118 and in particular with the flange opening 136. Integral with the screw drive housing 142 is an end bushing 144 and a shaft bushing 146 which rotatably receive the ends of a screw drive 148. Rotatably received on the screw drive 148 is a drive nut 150 that has a shoulder 152. As those skilled in the art will appreciate, the shoulder 152 selectively abuts the engaging flange 110 of the actuating member 104. The shaft bushing 146 is positioned such that it is disposed between the screw drive housing 142 and the motor housing 80. As such, the screw drive 148 extends into the motor housing 80 and has a drive bevel gear 154 that meshes and engages with a transfer bevel gear 156. A motor gear 158 rotates and drives the transfer bevel gear 156 in such a manner to rotate the screw drive 148 as desired. The motor gear 158 is driven by a reversible motor 160 that has a signal line 162 connected to the processor 22. Those skilled in the art will appreciate that the processor 22 controls the operation of the reversible motor 160 to rotate the screw drive 148 in the direction desired.

In operation, the currency 26 is inserted into the opening 24 whereupon the acceptor module 12 transports the currency past the top and bottom sensor plates 13 and 14 which verify the validity and denomination of the inserted paper and from that validation establishes the dimensions (length and width) thereof. In the preferred embodiment, the acceptor 12 accepts currency ranging between about 65 to about 83 millimeters in width and lengths ranging from about 125 mm to about 172 mm. If the sensor plates 13 and 14 determine that the currency is acceptable, an appropriate signal is sent to the processor 22 via signal line 74. If the currency 26 is unacceptable, the processor 22 reverses the motor 32 to reject currency 26 back to the user. However, if the currency is deemed acceptable, the processor 22 maintains the proper rotation of the motor 32 to transfer the currency 26 from the acceptor module 12 into the cassette cash box 18. In particular, the currency is transported along currency path 76 by the acceptor belt 60, the drive belt 40 and the stacker belt 88 into a preliminary position facing the punch plate 92.

Once the sensor 27 has transferred to the processor 22 data indicating the validity and denomination of the currency 26, the processor 22 generates a signal 162 received by the reversible motor 160 to direct the amount of rotation of the screw drive 148. That amount is a function of the physical size of the currency which, in turn, is determined by its denomination. Accordingly, the screw drive 148 moves the drive nut 150 in such a manner that the shoulder 152 abuts the engaging flange 110 of the actuating member 104. This movement forces the punch plate 92 to strike and push the currency 26 through the opening 91 and into a held position between the holding plate 94 and the side rails 90. The currency 26 is held in place by the force of the holding spring 96 which biases the holding plate 94 against the side rails 90 except for when the punch plate 92 is inserted between the side rails 90. As mentioned previously, the processor 22 controls the amount of movement or stroke of the punch plate 92 into the opening 91. The amount of stroke required to insert the currency 26 into the cassette housing 118 varies directly with the width of the currency 26. A large stroke is required with narrow notes because shifted or skewed narrow notes are pulled to one side during punching more than wide notes due to the greater disbalance of the resistance forces from one side to another. In other words, currency that has a narrow width requires a longer stroke to insure that any currency that is positioned predominately to one side or skewed within the opening 91 clears the predominant side rail 90. Because wider currency is more likely to be properly centered between the side rails 90 only a short stroke of the punch plate 92 is required.

Upon completion of the movement or stroke of the screw drive 148, the processor 22 commands the reversible motor 160 to reverse movement and withdraw the drive nut 150 to its original position. However, in this embodiment since the screw drive mechanism 20 is separate from the cassette cash box 18, the punch plate 92 remains in its fully stroked position. In order to return the punch plate 92 to the receiving position to receive another inserted denomination of currency, the pull-back spring 108 forces or pulls the punch plate 92 and the engaging flange 110 to return to its original position. Upon completion of this movement, the currency validator 10 is ready to receive another insertion of currency. Therefore, it will be appreciated that the punch plate 92 moves or punches the currency 26 from the preliminary position to a held or retained position within the detachable cassette cash box 18 by engaging the screw drive mechanism 20 to move the punch plate 92 a predetermined distance and then allowing the return of the punch plate the predetermined distance.

It is apparent then from the above description of the operation of the currency validator 10 that the problems associated with previous currency validators have been overcome. In particular, the currency validator 10 allows for the acceptance of various denominations and sizes of currency notes within a single cassette cash box 18. This is achieved by virtue of the cooperation between the screw drive mechanism 20 and the stacker assembly 16. In particular, the screw drive mechanism 20 allows for movement of the punch plate 92 various predetermined distances and the return thereof so as to accomodate any size of currency. Moreover, by controlling the amount of movement of the punch plate 92, the present invention has the advantage of being utilized in different countries around the world. Still another advantage of the present invention is that the cash cassette 18 only contains the stacker assembly 16 thus reducing the cost and maintenance of a cassette cash box 18.

Figure 4:
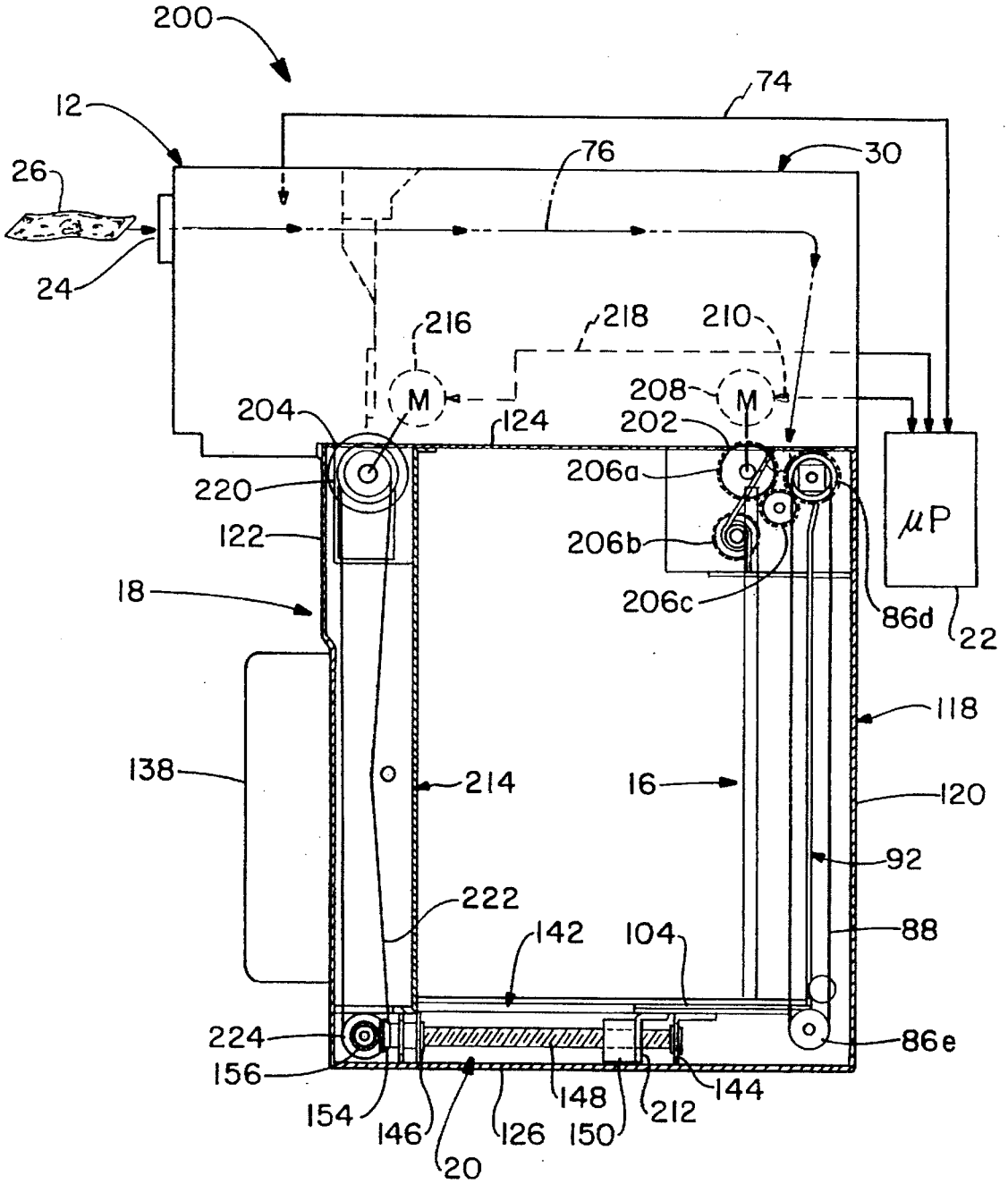
FIG. 4 is a partial cross-sectional and partial schematic diagram of an alternative embodiment according to the present invention.

Referring now to FIG. 4, an alternative currency validator with cassette cash box made in accordance with a second embodiment of the invention can be seen as generally designated by the numeral 200. It will be appreciated that much of the structure of the assembly 200 corresponds to that of the currency validator 10 and, in that regard, similar reference numerals have been employed where appropriate. Generally, the alternative embodiment is shown in a "down-stacker" configuration. In other words, the acceptor module 12 transfers the currency 26 into the drive unit 30, whereupon the currency path 76 directs the currency downwardly into the cassette cash box 18. As before, the currency 26 is placed in a preliminary or received position to allow a stacker assembly 16 to insert the currency into a held or retained position within the cassette cash box 18. It will be appreciated that in this embodiment the top 124 of the cassette housing 118 has a stacker gear opening 202 and a screw gear opening 204. Received within the stacker gear opening 202 are a plurality of stacker gears 206*a*, 206*b*, and 206*c* which mesh with and engage stacker roller 86*d* that drives a stacker belt 88 that is supported by a stacker roller 86*e*. A stacker motor 208 controls the operation and rotation of the stacker gears 206, wherein the motor 208 has a signal line 210 connected to a processor 22.

In this embodiment, the actuation member 104 has a connect flange 212 which interconnects the drive nut 150 to the actuation member 104. Included within the cassette housing 118 is a screw drive belt housing 214. In this embodiment, a screw drive motor 216 is connected to the processor 22 via a signal line 218 to control the operation of the screw drive mechanism 20. In particular, the screw drive motor 216 drives and rotates a screw drive gear 220 which controls the rotation and movement of a screw drive belt 222 that is supported by a screw drive roller 224. The screw drive roller 224 controls the rotation and drive of the transfer bevel gear 156 which accordingly rotates the screw drive 148. In this embodiment it will be appreciated that two motors 208, 216 are required to operate the stacker 16 and screw drive mechanism 20, both of which are contained within the cassette cash box 18.

In operation, the currency is delivered to the preliminary position with respect to the punch plate 92 as in the preferred embodiment. The processor 22 controls the operation of motor 208 so that stacker belt 88 is properly sequenced to deliver the currency 26 into the desired preliminary position. Once the desired position of the currency 26 has been obtained, the processor 22 activates motor 216 to engage transfer bevel gear 156 which rotates the screw drive 148. As such, the drive nut 150 rotates in such a manner to engage and move the connect flange 212 to direct the actuation member 104 of the strike plate 192 a predetermined distance and force the punch plate to insert the currency 26 between the side rails 90 in the manner described in the preferred embodiment. As before, the processor 22 determines the appropriate amount of stroke for the associated width of the currency 26 and stops the motor 216 at the appropriate time. Once the predetermined distance has been achieved, the motor 216 reverses direction and the screw drive 148 rotates in the opposite direction to push the drive nut 150 and associated strike plate 92 back the predetermined distance and place the strike plate in a position to receive additional insertions of currency.

It is apparent then from the above description of the operation and structure of the currency validator 200 that the problems associated with previous currency validators have been overcome. It will be appreciated that in this embodiment, the screw drive mechanism 20 operates in such a manner that the strike plate is controlled throughout the entire cycle of moving the currency from a preliminary position to a retained position within the cassette cash box 18. In particular, the drive nut 150 is integrally connected with the connecting flange 212 whereby the actuation member 104 is pushed and pulled the entire stroke of the strike plate required to fully insert the currency 26 into the cassette housing 118. Although this embodiment requires the inclusion of both the stacker assembly 16 and the screw drive mechanism 20 in the cassette cash box 18 it still provides the advantages presented in the preferred embodiment.

Thus it can be seen that the objects of the invention have been attained by the structure presented above. While in accordance with the patent statutes only the best mode and preferred embodiments of the invention have been presented and described in detail, the invention is not limited thereto or thereby. Accordingly, for an appreciation of the true scope and breadth of the invention, reference should be made to the following claims.

What is claimed is:

1. A currency validator with cassette cash box, comprising:

an acceptor module for receiving various sizes of currency;

means for validating whether the currency meets predetermined criteria and for determining a size of the currency, said validating means coupled to said acceptor module;

a stacker for receiving the currency from said acceptor module and inserting the currency into a cassette cash box; and a screw drive mechanism operative with said stacker, wherein said screw drive mechanism controls an amount of travel of said stacker depending upon the size of the currency as determined by said validating means to insert the currency into said cassette cash box.

2. The currency validator according to claim 1, further comprising:

a processor to control the operation of said stacker via said screw drive mechanism, wherein said processor is coupled to said validating means to determine the size of the currency and to determine and control the amount of travel required by said stacker.

3. The currency validator according to claim 2, wherein said cash cassette box is detachable from said validating means and said acceptor module.

4. The currency validator according to claim 2, wherein said screw drive mechanism comprises:

a transfer bevel gear operatively rotated by a motor connected to said processor;

a drive bevel gear meshing with said transfer bevel gear, said drive bevel gear rotating a screw drive; and a drive nut rotatably mounted on said screw drive, wherein said drive nut engages said stacker and moves said stacker the amount of travel determined by said processor.

5. The currency validator according to claim 4, wherein said cassette cash box contains said stacker.

6. The currency validator according to claim 4, wherein said cassette cash box contains said stacker and said screw drive mechanism.

7. A currency validator with a detachable cash cassette for receiving and storing currency, comprising:

means for accepting and determining a size of currency;

first means for transferring inserted currency from said accepting means to a preliminary position;

a screw drive mechanism engageable with a punching means; and second means for transferring the currency from the preliminary position to a held position within the detachable cash cassette by actuating said screw drive mechanism to move said punching means a predetermined distance according to the size of the accepted currency and then returning said punching means the predetermined distance.

8. The currency validator according to claim 7 further comprising:

a processor for controlling the operation of said first and second transferring means and said screw drive mechanism.

9. The currency validator according to claim 8, wherein said punching means comprises:

a punch plate having an actuating member, said actuating member having a flange means for operatively engaging said screw drive mechanism, wherein said punch plate opposes the preliminary position of the currency and punches the currency into the held position as said screw drive mechanism moves said flange means.

10. The currency validator according to claim 9, wherein said detachable cash cassette includes a holding plate biased by a holding spring, and a pair of opposed side rails forming an opening, said side rails interposed between said holding plate and said punch plate when the currency is in the preliminary position, wherein said punch plate is receivable in said opening to place the currency in the held position, the currency being wider than said opening.

11. The currency validator according to claim 10, wherein said punch plate pushes the currency through said opening onto said holding plate, said holding spring forcing said holding plate and the currency against said side rails after said punch plate is returned the predetermined distance.

12. The currency validator according to claim 11, wherein said detachable cash cassette contains said punching means.

13. The currency validator according to claim 11, wherein said detachable cash cassette contains said punching means and said screw drive mechanism.

14. A currency validator, comprising:

a housing;

a cassette cash box detachably received within said housing, said cassette cash box receiving and holding any size currency; and a stacker having an actuation member contained within said cassette cash box, said stacker operatively controlled by a screw drive mechanism which has a drive nut that selectively engages said actuation member to move the currency from a received position to a held position within said cassette cash box.

15. The currency validator according to claim 14, wherein said actuation member has an extending flange, and wherein said drive nut is rotatably received on a screw, said drive nut engaged by said extending flange when said screw is rotated in at least one direction.

16. The currency validator according to claim 15, wherein said cassette cash box comprises:

a cassette housing having a pair of spaced apart rails forming an opening; and a holding plate biased by a holding spring, said holding spring affixed at one end to said cassette housing to urge said holding plate toward said rails;

said stacker having a punch plate sized to fit between said rails, said punch plate moved by said screw drive mechanism to move the currency from the received position through said opening to the held position between said holding plate and said rails.

17. The currency validator according to claim 16, wherein said cassette cash box has a pull-back spring connected to said punch plate, said drive nut abutting said extending flange, whereby when said screw rotates in one direction a predetermined distance, said punch plate moves the currency to the held position and upon reaching the predetermined distance, said pull back spring returns said punch plate in an opposite direction the predetermined distance.

18. The currency validator according to claim 16, wherein said drive nut is connected to said extending flange, whereby when said screw rotates in one direction a predetermined distance, said punch plate moves the currency to the held position and upon reaching the predetermined distance said screw rotates in an opposite direction to return said punch plate the predetermined distance.

* * * * *